US006102006A

United States Patent [19]

Schmidt

[11] Patent Number: 6,102,006

[45] Date of Patent: Aug. 15, 2000

[54] FUEL INJECTION SYSTEM FOR DIESEL MOTORS

[75] Inventor: Harald Schmidt, Vienna, Austria

[73] Assignee: Steyr-Daimler-Puch Aktiengesellschaft, Vienna, Austria

[21] Appl. No.: 09/242,773

[22] PCT Filed: Aug. 20, 1997

[86] PCT No.: PCT/AT97/00189

§ 371 Date: Feb. 22, 1997

§ 102(e) Date: Feb. 22, 1997

[87] PCT Pub. No.: WO98/07979

PCT Pub. Date: Feb. 26, 1998

[30] Foreign Application Priority Data

Aug. 23, 1996 [AT] Austria ..... 1513/96

[51] Int. Cl.[7] ..... F02M 37/04

[52] U.S. Cl. ..... 123/446; 123/467

[58] Field of Search ..... 123/445, 446, 123/447, 495

[56] References Cited

U.S. PATENT DOCUMENTS 5,299,738 4/1994 Genter et al. ..... 123/467

5,638,791 6/1997 Tsuzuki ..... 123/467

FOREIGN PATENT DOCUMENTS 3325479 1/1984 Germany .

545847 6/1941 United Kingdom .

*Primary Examiner*—Thomas N. Moulis

*Attorney, Agent, or Firm*—Bachman & LaPointe, P.C.

[57] ABSTRACT

An injector unit consists of a housing (1), of a controllable piston pump (5) and of an injection nozzle (4) adjoining the latter and having a nozzle chamber (25), the housing (1) possessing a fuel supply chamber (23) fed from outside and a return orifice (24) leading outward, the piston pump (5) possessing a pump piston bush (6) which is guided on a pin (20) fixed relative to the housing and which has control orifices (17), and the pin (20) containing a first longitudinal bore (39) leading from the interior (18) of the pump piston bush (6) to the injection nozzle (4). In order to improve sealing and through flow, the pump piston bush (6) is surrounded by a sealing sleeve (50), the pin (20) has a second longitudinal bore (57) and the sealing space (53) is flow-connected to the return orifice via a second transverse bore (58) and a third longitudinal bore (59) in the pin (20).

6 Claims, 3 Drawing Sheets

FUEL INJECTION SYSTEM FOR DIESEL MOTORS

Figure 1:
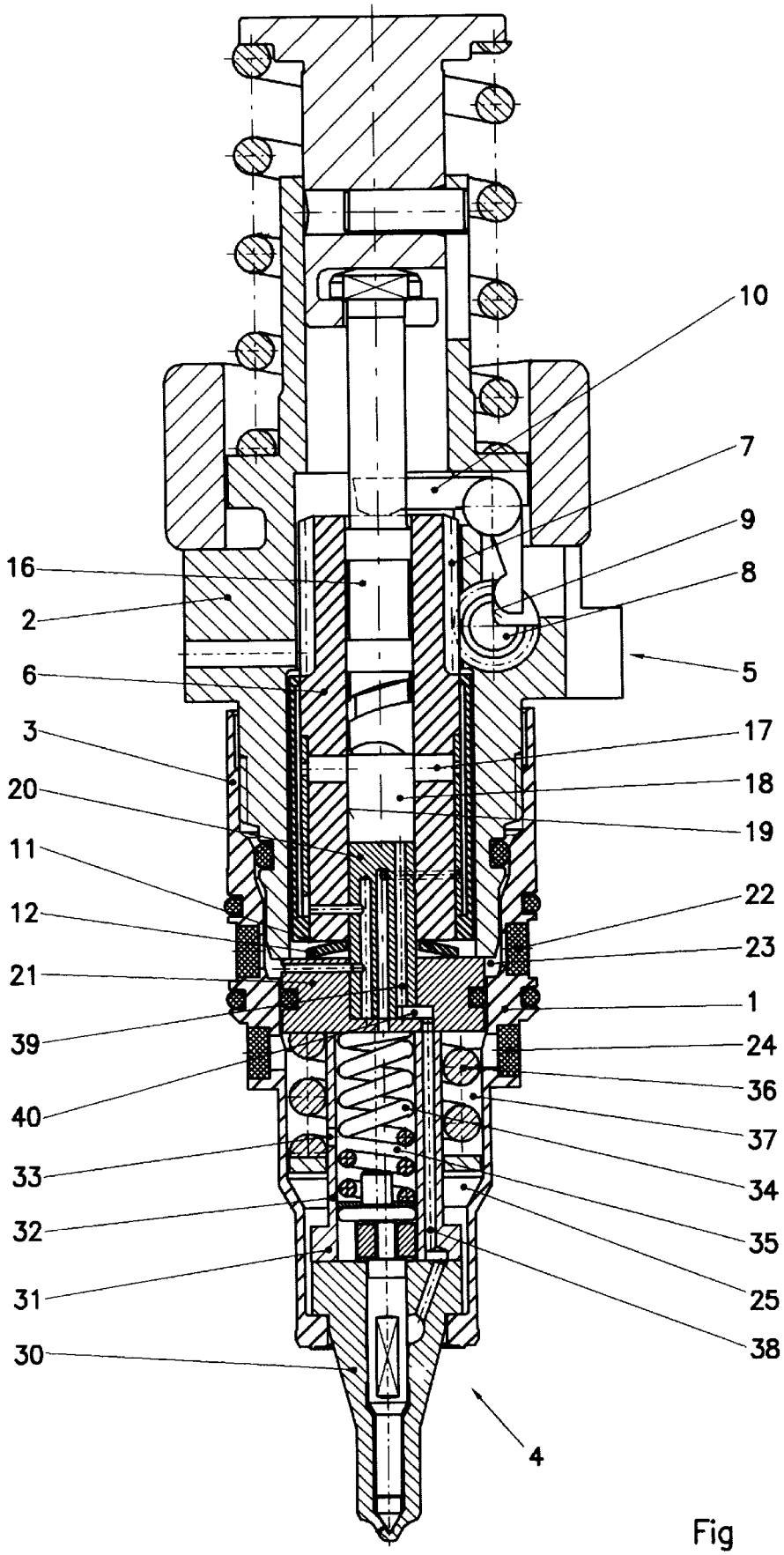

The invention is concerned with a fuel injection assembly, in each case for one cylinder of a diesel engine, said assembly consisting of a housing, of a controllable piston pump and of an injection nozzle adjoining the latter and having a nozzle chamber, the housing possessing a fuel supply chamber fed from outside and a return orifice leading outward, the piston pump possessing a pump piston bush which is mounted longitudinally displaceably and is guided on a coaxial pin fixed relative to the housing and which has at least one control orifice, and the pin containing a first longitudinal bore leading from the interior of the pump piston bush to the injection nozzle.

In generic injection assemblies, also referred to as "injector units", which are known from DE 33 25 479 C2, the pump piston bush is rotatable, for example for the purpose of controlling the injection quantity; in order to control the start of injection, said pump piston bush is additionally also positively displaceable in the axial direction. Located between the pump piston bush and the housing is a fuel inflow chamber which has to be separated by means of a seal from the chamber located above it and containing the adjusting members and lubricating oil. This seal presents problems, since it must be absolutely leaktight, even under the highly pulsating fuel pressure which occurs when the feed stroke is cut off. The seal therefore experiences wear and frictional losses which increase the actuating force. Moreover, gas bubbles or air bubbles may form in the inflow chamber, but also in the nozzle chamber below it, at locations of low flow velocity, particularly in upwardly closed pockets and at locations of higher temperature. The result is irregular pump conveyance and, as a consequence, uneven engine running. Furthermore, this design requires impact protection in order to protect the inner wall of the housing against erosion.

The object on which the invention is based is, therefore, to eliminate these defects and to improve the sealing and throughflow of an injector unit.

This is achieved, according to the invention, in that, firstly, the pump piston bush is sealingly surrounded by a sealing sleeve which forms, with the outer wall of the pump piston bush, a closed sealing space, into which the control orifice opens at the top and a first transverse bore of the pump piston bush opens at the bottom, in that, secondly, the pin possesses a second longitudinal bore which is flow-connected, on the one hand, to the fuel supply chamber and, on the other hand, via the first transverse bore, to the sealing space, and in that, thirdly, the sealing space is flow-connected to the return orifice via a second transverse bore and a third longitudinal bore in the pin.

The fuel thus flows from the fuel supply chamber through the second longitudinal bore in the pin and the sealing space into the working chamber in the pump piston bush. The fuel jet occurring during cutoff flows from the connecting chamber via the second transverse bore and a third longitudinal bore in the pin to the return orifice. As a result, the seal which presents problems between the pump piston bush and the housing is avoided and its function is performed by the high pressure seal which exists in any case between the inner surface of the pump piston bush and the pin. This high pressure seal is a cylindrical surface of small diameter, without sealing rings and with a long guide length, which, in addition to this, is lubricated hydrodynamically by a leakage flow, the quantity of which is insignificant. The forces which occur are therefore low. Another advantage is that along the flow path described there are no longer any dead zones where vapor bubbles or air bubbles could form. Moreover, the fluctuating pressure in the return can no longer exert any disturbing forces on the displaceable pump piston bush.

In an advantageous development of the invention, the third longitudinal bore in the pin opens into the nozzle chamber which is connected to the return by means of an orifice in the housing (claim 2). Thus, the nozzle chamber is included in the fuel flow. As a result, the formation of vapor or air bubbles is prevented in this nozzle chamber, too, and cooling is additionally ensured, thus counteracting the formation of vapor bubbles.

In a preferred embodiment, the pin is part of an intermediate plate possessing a duct which makes the connection between the fuel supply chamber and the second longitudinal bore of the pin (claim 3). In addition to making assembly simpler, the intermediate plate ensures that the pumping chamber and nozzle chamber are separated, thus resulting in a positive flow through the nozzle chamber, too.

If, furthermore, the nozzle chamber consists of two spring chambers separated by a wall and the wall has a passage bore, the third longitudinal bore opening into one spring chamber and the return orifice being arranged at the highest point of the other spring chamber (claim 4), proper flow guidance is ensured and it is certain that any pockets in which gas bubbles could collect will be absent. For, of course, the third longitudinal bore also opens out at the highest point of the one spring chamber.

In a further embodiment of the invention, the pump piston bush is surrounded in the connecting space by a tubular throttle plate which has a throttle bore above the control orifice (claim 5). The sealing sleeve is thereby protected from the sharp fuel jet during cutoff, this being beneficial to its service life. Moreover, it can have smaller dimensions and is easier to mount than a sealing sleeve which is arranged in the housing.

Finally, there may also be provision for the longitudinally displaceable and, if appropriate, also rotatable pump piston bush to be supported on the intermediate plate via a cup spring (claim 6). The small overall height of a cup spring makes it possible to give the pin a long guide length along with a small overall height. Furthermore, the positive connection between the pump piston bush and its adjusting means may thereby be dispensed with, since resetting takes place by means of spring force. This is also relevant to safety, because, if the actuator fails, the pump piston bush is returned by spring force into the position of the least feed quantity.

Figure 2:
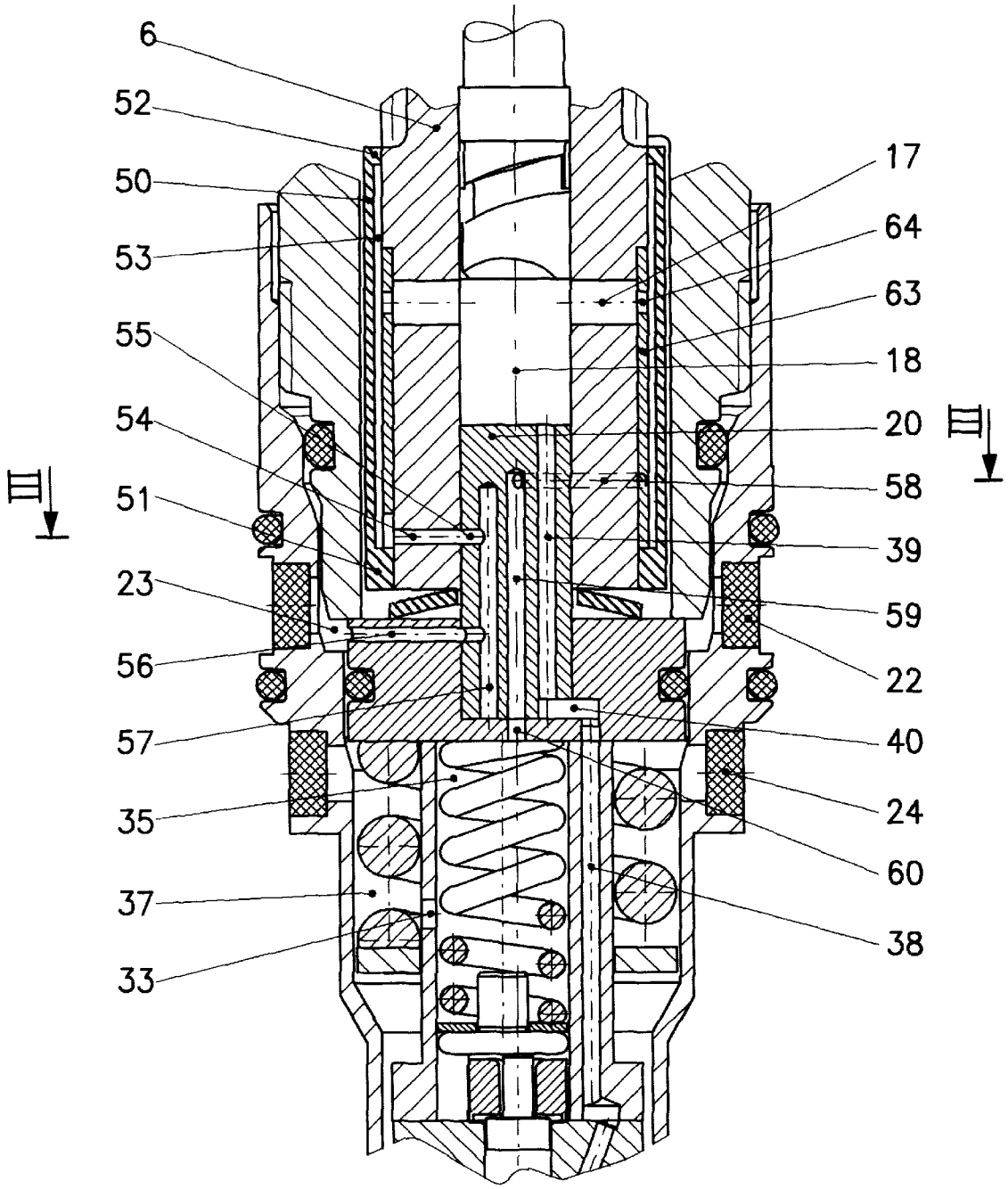
Figure 3:
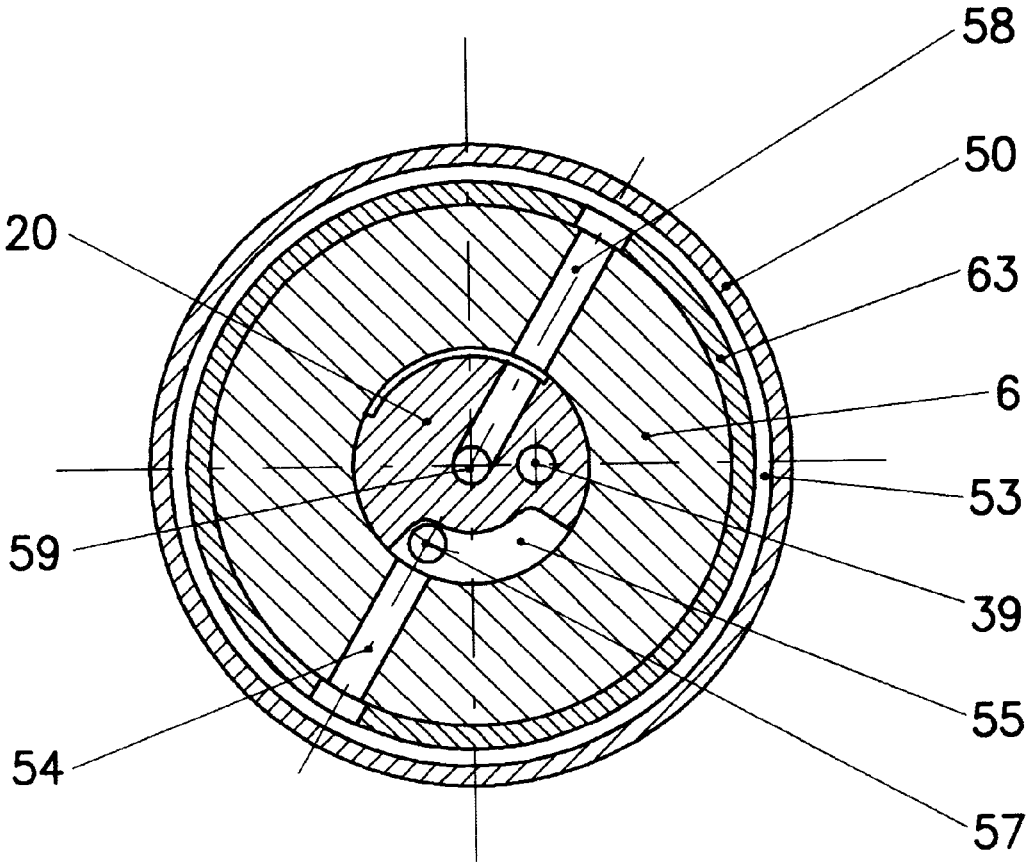

The invention is described and explained below by means of figures of which:

FIG. 1: illustrates a longitudinal section through an injector unit according to the invention, FIG. 2: shows a detail from FIG. 1, enlarged, and FIG. 3: shows a cross section according to III—III in FIG. 2.

In FIG. 1, the housing of an injector unit according to the invention is designated by 1. Said housing consists of a pump casing 2 and of a nozzle holder 3 which is screwed to the latter and the lower edge of which holds an injection nozzle 4. Located in the pump casing 2 is a piston pump 5 formed by a pump piston bush 6 which is adjustable upward and downward and, if appropriate, is also rotatable. For this purpose, its upper part is provided with an adjusting toothing 7, into which a control rod 8 engages.

In the exemplary embodiment described, the control rod 8 is displaced perpendicularly to the drawing plane in order to adjust the feed quantity and is rotated about an axis perpendicular to the drawing plane in order to adjust the start of injection. For this purpose, said control rod has a control surface 9 which, via an angle lever 10, causes the pump piston bush to be raised and lowered. A cup spring 12 engages on the lower end face 11 of said pump piston bush and counteracts the lowering of the latter.

The piston pump 5 also includes a pump piston 16 which is actuated in a known way by a tappet, on which a camshaft, not illustrated, acts, said pump piston having in a known way control surfaces which, in interaction with control orifices 17, determine the start and end of injection. The pump piston 16, together with the precision-machined inner wall 19 of the pump piston bush 6, delimits a working chamber 18.

A pin 20 projects with a very exact fit into the lower part of the pump piston inner wall 19. Said pin is either part of an intermediate plate 21 or connected completely fixedly to the latter. The intermediate plate 21 is fitted sealingly into the housing 1 of the injector unit more precisely: of the nozzle holder. The housing 1, in particular the nozzle holder 3, has, above the intermediate plate 21, a fuel inlet orifice 22 or a plurality of these, distributed over the circumference, which lead into an annular fuel supply chamber 23. At least one return orifice 24 is arranged directly below the intermediate plate 21 in the same way, the fuel not injected flowing through said return orifice back into corresponding collecting ducts, not illustrated, of the engine block. The return orifice leads out of an, in this case, annular nozzle chamber 25.

The intermediate plate 21 and the lower part of the nozzle holder 3 form the nozzle chamber 25. Located in the latter is a nozzle body 30, with an attachment 31 which forms a wall 32 having a passage bore 33. Within this wall 32, a first nozzle spring 34 is located in a first spring chamber 35, and outside said wall a second nozzle spring 36 is located in a second spring chamber 37. The thickness of the wall 32 differs over the circumference, and, at its thickest point, there passes through it the pressure bore 38 which leads to the nozzle body 30 and to which the fuel is fed from the working chamber 18 via the first longitudinal bore 39 and a transverse offset 40.

The parts to be described now can be seen more clearly in FIG. 2. The pump piston bush 6 is surrounded, over the greatest part of its length, by a sealing sleeve 50 which sits with a lower ring 51 and an upper ring 52 sealingly on the outer wall of the pump piston bush 6 and thus forms with the latter a sealing space 53. Into the latter leads a first transverse bore 54 which is connected to the fuel supply chamber 23, if appropriate via an annular duct 55 and a duct 56 in the intermediate plate 21. For this purpose, a second longitudinal bore 57 is provided in the pin 20. Said longitudinal bore is a blind bore, the orifice of which either is closed by means of a plug, not illustrated, or is closed by pressing into the intermediate plate 21. The control orifice or control orifices also open into the sealing space 53.

Furthermore, the pump piston bush 6 has passing through it a second transverse bore 58 which leads from the sealing space 53, again via an annular duct 61 if appropriate, to a third longitudinal bore 59 in the pin 20. Said third longitudinal bore opens at the bottom, at 60, into the first spring chamber 35.

Finally, the pump piston bush 6 is also surrounded, in the sealing space 53, by a closely fitting tubular throttle plate 63, the throttle bore 64 of which breaks up the energy of the fuel flowing through the control orifices 17 during cutoff and thus protects the sealing sleeve 50 against erosion.

The flow path of the fuel is therefore as follows: from the fuel inlet orifice 22 to the fuel supply chamber 23, from there through the duct 56 into the second longitudinal bore 57; from the second longitudinal bore 57 through the first transverse bore 54 into the sealing space 53, and finally through the control orifices 17 into the working chamber 18. This flow is brought about by the admission pressure generated by a fuel feed pump which is not illustrated. When the feed is cut off at the end of feed, superfluous fuel shoots through the control orifices 17 back into the sealing space 53 again and, from this, through the second transverse bore 58 into the third longitudinal bore 59. The latter opens at 60 into the first spring chamber 35, and said fuel flushes through and cools the latter and then, after flowing through the passage bore 33, also the second spring chamber 37 and leaves the housing at the return orifice 24 located at the highest point of this second spring chamber 37.

What is claimed is:

1. A fuel injection assembly, in each case for one cylinder of a diesel engine, consisting of a housing (1), of a controllable piston pump (5) and of an injection nozzle (4) adjoining the latter and having a nozzle chamber (25), the housing (1) possessing a fuel supply chamber (23) fed from outside and a return orifice (24) leading outward, the piston pump (5) possessing a pump piston bush (6) which is mounted longitudinally displaceably and is guided on a coaxial pin (20) fixed relative to the housing and which has at least one control orifice (17), and the pin (20) containing a first longitudinal bore (39) leading from the interior (18) of the pump piston bush (6) to the injection nozzle (4), wherein a) the pump piston bush (6) is sealingly surrounded by a sealing sleeve (50) which, with the outer wall of the pump piston bush (6), forms a closed sealing space (53), into which the control orifice (17) opens at the top and a first transverse bore (54) of the pump piston bush (6) opens at the bottom, b) the pin (20) possesses a second longitudinal bore (57) which is flow-connected, on the one hand, to the fuel supply chamber (23) and, on the other hand, via the first transverse bore (54), to the sealing space (53), c) the sealing space (53) is flow-connected to the return orifice via a second transverse bore (58) and a third longitudinal bore (59) in the pin (20).

2. The fuel injection assembly as claimed in claim 1, wherein the third longitudinal bore (59) in the pin (20) opens into the nozzle chamber (25; 35) which is connected to the return orifice (24) in the housing.

3. The fuel injection assembly as claimed in claim 1, wherein the pin (20) is part of an intermediate plate (21) having a duct (56) which makes the connection between the fuel supply chamber (23) and the second longitudinal bore (57) in the pin.

4. The fuel injection assembly as claimed in claim 2, wherein the nozzle chamber (25) consists of two spring chambers (35, 37) separated by a wall (32) and the wall (32) has a passage bore (33), the third longitudinal bore opening into one spring chamber and the return orifice being arranged at the highest point of the other spring chamber.

5. The fuel injection assembly as claimed in claim 1, wherein the pump piston bush (6) is surrounded, in the sealing space (53), by a tubular throttle plate (63) which has a throttle bore (64) above the control orifice (17).

6. The fuel injection assembly as claimed in claim 3, wherein the pump piston bush (6) is displaceable in the longitudinal direction and is supported on the intermediate plate (21) via a cup spring (12).

* * * * *